US009279287B2

(12) United States Patent
Balay et al.

(10) Patent No.: US 9,279,287 B2
(45) Date of Patent: Mar. 8, 2016

(54) OVERHEAD DOOR WITH LINTEL SEAL INTERFACE ASSEMBLY

(71) Applicant: CIW Enterprises, Inc., Mountaintop, PA (US)

(72) Inventors: Joseph L. Balay, Sugarloaf, PA (US); Joseph L. Kondash, Wilkes-Barre, PA (US)

(73) Assignee: CIW Enterprises, Inc, Mountaintop, PA (US)

( * ) Notice: Subject to any disclaimer, the term of this patent is extended or adjusted under 35 U.S.C. 154(b) by 0 days.

(21) Appl. No.: 14/312,206

(22) Filed: Jun. 23, 2014

(65) Prior Publication Data

US 2015/0197985 A1 Jul. 16, 2015

Related U.S. Application Data

(60) Provisional application No. 61/839,987, filed on Jun. 27, 2013.

(51) Int. Cl.

| | |
|---|---|
| ***E06B 9/56*** | (2006.01) |
| ***E06B 9/58*** | (2006.01) |
| ***E06B 9/17*** | (2006.01) |

(52) U.S. Cl.

CPC ..... *E06B 9/58* (2013.01); *E06B 9/17076* (2013.01); *E06B 2009/588* (2013.01)

(58) Field of Classification Search

CPC .. E06B 9/58; E06B 2009/588; E06B 9/17076
USPC ..... 160/40, 41; 16/366, 368–369
See application file for complete search history.

(56) References Cited

U.S. PATENT DOCUMENTS

| | | | | | |
|---|---|---|---|---|---|
| 68,150 | A * | 8/1867 | Baker | E05D 3/12 | 16/366 |
| 428,402 | A * | 5/1890 | Morris | E05D 3/12 | 16/366 |
| 625,678 | A * | 5/1899 | Hilzheim | E05D 3/06 | 16/368 |
| 1,554,161 | A * | 9/1925 | Hubbard | E05D 3/06 | 16/368 |
| 3,339,619 | A * | 9/1967 | Crosswell | B60J 5/14 | 160/40 |
| 3,489,200 | A * | 1/1970 | Recchione | E05D 15/24 | 160/133 |
| 3,757,845 | A * | 9/1973 | Pagliaro | E05D 15/262 | 16/87 R |

(Continued)

FOREIGN PATENT DOCUMENTS

| | | | | |
|---|---|---|---|---|
| EP | 1935281 | | 6/2008 | |
| EP | 2017509 | | 1/2009 | |
| IT | WO 9618796 | A2 * | 6/1996 | E06B 9/54 |

*Primary Examiner* — Katherine Mitchell
*Assistant Examiner* — Johnnie A Shablack
(74) *Attorney, Agent, or Firm* — Mitchell A. Smolow

(57) ABSTRACT

An overhead coiling door which includes a lintel seal interface assembly comprising a mounting bracket and a seal material sandwiched between a top and bottom row of brush bristles. The top row of bristles is shorter than the bottom row which provides relative rigidity to the flexible seal material and maintains greater cycle life. Further described are novel insulating material placement used to seal the building structure—door gaps. In one preferred design, a hinged guide cover has a first leg geometry to engage the structure and a second leg geometry to engage the curtain guide assembly to effectively seal gaps created by various amounts of curtain guide assembly setback.

19 Claims, 5 Drawing Sheets

(56) References Cited

U.S. PATENT DOCUMENTS 4,467,853 A * 8/1984 Downey, Jr. ..... E06B 9/15 160/133
4,957,301 A * 9/1990 Clay, Jr. ..... B60J 5/14 160/40
5,201,530 A * 4/1993 Kelch ..... F16J 15/3288 277/355
5,419,084 A * 5/1995 Sankey ..... E06B 7/367 16/250
5,445,209 A * 8/1995 Lichy ..... E06B 9/13 160/273.1
5,480,165 A * 1/1996 Flower ..... F16J 15/3288 277/355
5,482,104 A * 1/1996 Lichy ..... E06B 9/13 160/273.1
5,544,690 A * 8/1996 Magro ..... E06B 9/11 160/133
5,657,805 A * 8/1997 Magro ..... E06B 9/581 160/133
6,129,130 A * 10/2000 Rekret ..... E05D 15/242 160/40
6,357,507 B1 * 3/2002 Stoebich ..... A62C 2/10 160/121.1
6,374,567 B1 * 4/2002 Mullet ..... E06B 3/485 160/201
6,497,073 B2 * 12/2002 Webb ..... E06B 7/367 16/250
7,089,990 B2 * 8/2006 Hormann ..... E05D 15/165 160/201
7,182,119 B2 * 2/2007 Woodward ..... E06B 7/22 160/102
7,784,520 B2 * 8/2010 Paulson ..... E05D 15/24 16/91
8,113,265 B2 * 2/2012 Hardison, III ..... E06B 9/13 160/179
8,146,985 B2 * 4/2012 Nelson ..... E06B 9/582 160/229.1
8,505,923 B2 * 8/2013 Ferryman ..... F28D 19/047 277/355
8,910,421 B2 * 12/2014 Potter ..... E06B 7/231 49/197
9,068,655 B2 * 6/2015 Ferryman ..... E06B 7/22
2008/0309017 A1 * 12/2008 Mattice ..... A46B 5/06 277/355
2011/0227289 A1 9/2011 Stefan
2013/0098566 A1 * 4/2013 Horvath ..... E06B 9/58 160/273.1
2013/0220559 A1 * 8/2013 Dwarka ..... E06B 9/17007 160/272
2013/0263516 A1 * 10/2013 Potter ..... E06B 7/231 49/493.1
2013/0277918 A1 * 10/2013 Fitzgerald ..... F01D 11/00 277/355
2013/0306252 A1 * 11/2013 Lambridis ..... E06B 9/13 160/133

* cited by examiner

OVERHEAD DOOR WITH LINTEL SEAL INTERFACE ASSEMBLY

CROSS REFERENCE TO RELATED APPLICATIONS

This application claims benefit of U.S. Provisional Application No. 61/839,987 filed Jun. 27, 2013.

FIELD OF THE INVENTION

This invention relates generally to overhead doors and in particular, to an overhead door with a lintel seal.

BACKGROUND OF THE INVENTION

Rolling Steel Doors are metal slatted overhead coiling doors that roll up to store in coil above the opening. They are used to provide security against entry or to provide weather protection at exterior and interior openings in industrial, commercial, institutional and other buildings. They are also called overhead coiling doors or service doors.

Although they are sometimes considered to be interchangeable there are dramatic differences between Rolling Steel and Sectional Doors. Some of these differences are based on material, with Rolling Steel doors generally having heavier duty, sustainable construction. Also, Rolling Steel Doors have mounting advantages that make them uniquely suitable for specific applications.

Rolling Steel Doors have many fewer parts than sectional doors with less risk for damage and inoperability making them a better solution for facilities that cannot afford opening downtime. Sectional garage doors have 30 to 40 moving parts that are all exposed and subject to dirt, debris and damage. Any of these parts if faulty or damaged will cause the door to become completely inoperable and/or pose a serious life safety risk.

Rolling steel doors have a heavy duty steel curtain that coils upon a counterbalance shaft. Their heavy duty springs are protected and sealed inside the counterbalance shaft and heavily coated with grease to eliminate the possibility of rust or freezing.

Coiling doors are mounted to the face of the wall and supported by vertical guide assemblies. They require no connection to the ceiling or roof structure. Sectional garage doors are typically mounted to the vertical face of the wall, but a horizontal track must be supported from the ceiling or roof structure.

With any door design, if there is passage of air or water between the door and the structure, damage to the structure interior and its contents may result. Heating and cooling costs may also be adversely affected. To prevent these problems various barriers have been designed. One such design sandwiches a relatively rigid sheet between two rows of bristles, all of equal length. However, this design of equal length bristles has proven to be less than effective.

Accordingly, there is still a continuing need for improved designs to eliminate the overhead door lintel and guide assembly—building structure gap. The present invention fulfills this need and further provides related advantages.

BRIEF SUMMARY OF THE INVENTION

The overhead door using a lintel seal interface assembly described below is a novel design to help reduce or prevent outside air, wind, rain, or snow from passing through the door—structure interface without adversely affecting door operation.

In a preferred embodiment an overhead coiling door includes a lintel seal interface assembly comprising a mounting bracket and a seal material sandwiched between a top and bottom row of brush bristles, the top row of bristles being shorter than the bottom row. This interface assembly geometry provides relative rigidity to the flexible seal material and maintains greater cycle life.

Further described are novel insulating material placement used to seal the building structure—door gaps. In one preferred design, a hinged guide cover has a first leg geometry to engage the structure and a second leg geometry to engage the guide assembly to effectively seal gaps created by various amounts of guide assembly setback.

The hinged guide cover offers some distinct advantages, for example, it acts as a trim piece to close off the guide assemblies from the exterior using fasteners for positive attachment to the guide assemblies and the wall; it thermally breaks the guide assemblies from the outside temperature to reduce temperature transfer into the building preventing the guide assemblies from sweating/frosting depending on the outside temperature; it provides the ability to have a slide in seal for the guide assemblies; and it is more robust than solely applying foam, making inadvertent loss of insulation less likely.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
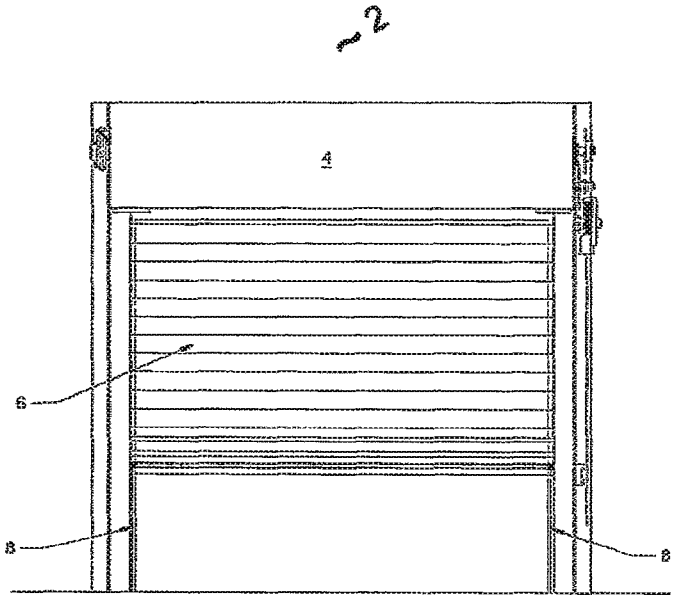
FIG. 1 is a front view of an overhead coiling rolling steel door.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

For purposes of this disclosure the term "operator" is meant to comprise both motorized and non-motorized assemblies that provide turning force to the counterbalance shaft.

Figure 2:
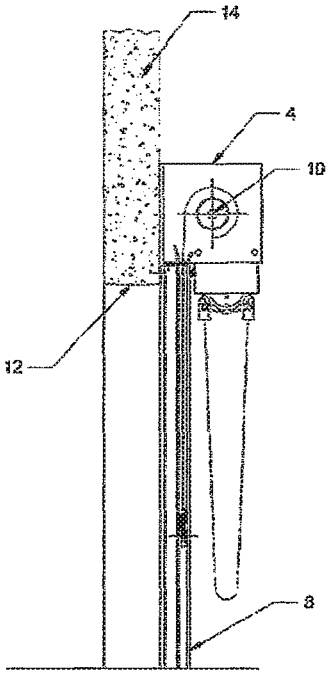
FIG. 2 is a side view of the overhead coiling rolling steel door of FIG. 1.

Turning now to the figures, FIGS. 1 and 2 depict an overhead door, for example, and overhead coiling rolling steel door 2 comprising an operator 4, a coiling curtain 6, for example operatively connected metal slats, and curtain retaining guide assemblies 8. The coiling curtain 6 travels and is maintained within guide assemblies 8 as the curtain is wound and unwound around an operator driven counterbalance shaft 10. The guide assemblies 8 have curved portions 54 at their top end to form a bell mouth. (See FIGS. 4, 6, and 10*a*-10*c*).

A lintel seal interface assembly 12 is mounted to the door lintel 14. For purposes of this specification, the term lintel refers to a horizontal structural member over an opening which carries the weight of the wall above it. The components of the lintel seal interface assembly 12 comprise a bracket 16 and a brush assembly 18 (FIGS. 4 and 6).

Figure 3:
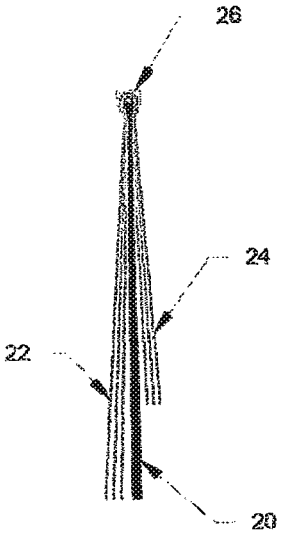
FIG. 3 is a side view of a lintel seal interface brush assembly.

Depicted in FIG. 3, the brush assembly 18 comprises a seal material 20, preferably a flexible seal material, for example an ethylene propylene diene monomer ("EPDM") sheet, sandwiched between a longer bottom set of bristles 22 and a shorter top set of bristles 24. A key 26 is formed opposite the bristle end. The shorter top set of bristles 24 are preferably about 1.25 inches to about 0.5 inches shorter than the longer bottom set of bristles 22, and most preferably, about 0.75 inches shorter.

When the door is closed, the shorter top set of bristles 24 allow the EPDM sheet to contact and conform to any irregularity in the door curtain 6 to provide a more effective seal than that provided by top and bottom bristles of equal length. It was found that top bristles and bottom bristles of equal length interfered with the seal material contacting the curtain. Top and bottom bristles of the same length prevented the EPDM sheet from effectively sealing to the curtain. The sealing failure prevented a door from meeting the Air Infiltration Standard (IECC 2012) of 1.0 cfm/sq ft., incorporated by reference. When a lintel seal interface assembly 12 comprising the novel design of a shorter top set of bristles was incorporated into the door the requirements of Air Infiltration Standard (IECC 2012) were unexpectedly met.

Figure 4:
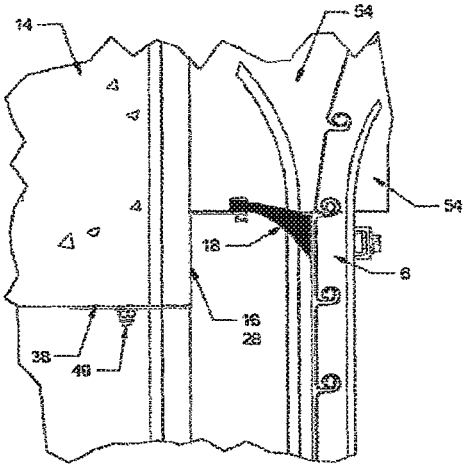
FIG. 4 is a side view of an installed lintel seal interface assembly using a Z bracket.
Figure 5:
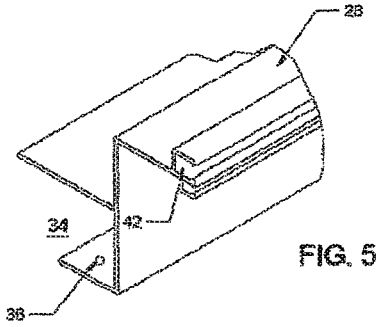
FIG. 5 is a perspective view of the Z bracket of FIG. 4.
Figure 6:
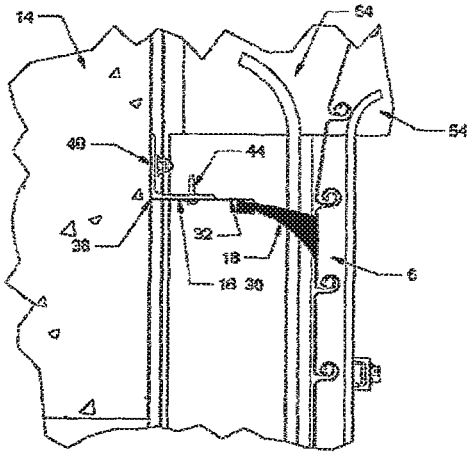
FIG. 6 is a side view of an installed lintel seal interface assembly using an L bracket.
Figure 7:
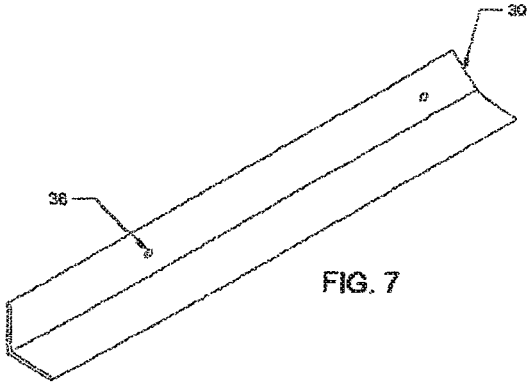
FIG. 7 is a perspective view of the L bracket of FIG. 6.
Figure 8A:
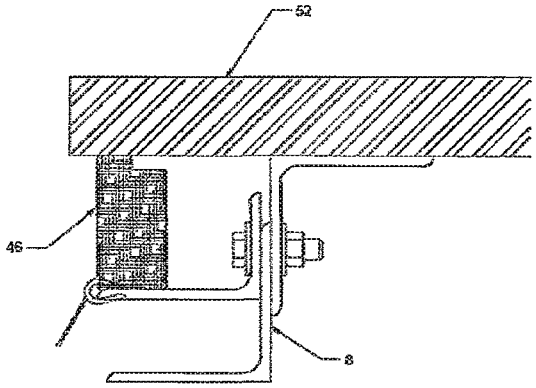
FIGS. 8*a*-8*h* are top views of a guide assembly with sealing materials.
Figure 8B:
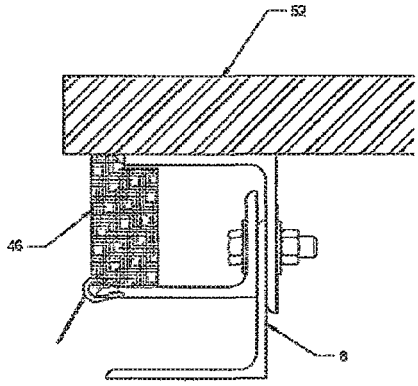
Figure 8C:
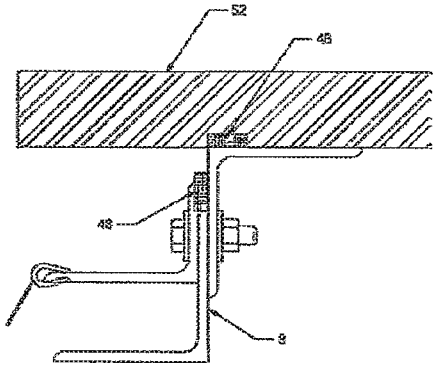
Figure 8D:
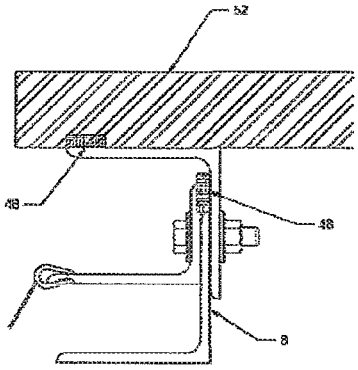
Figure 8E:
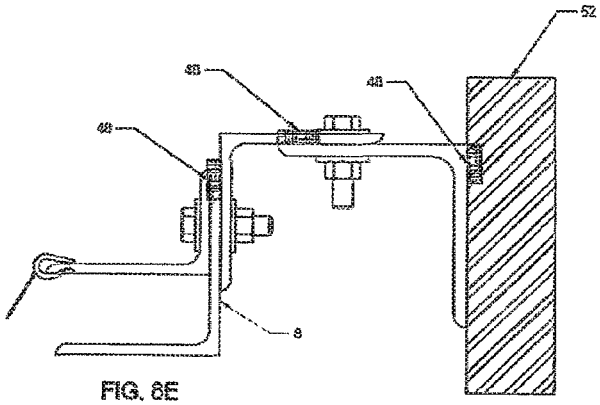
Figure 8F:
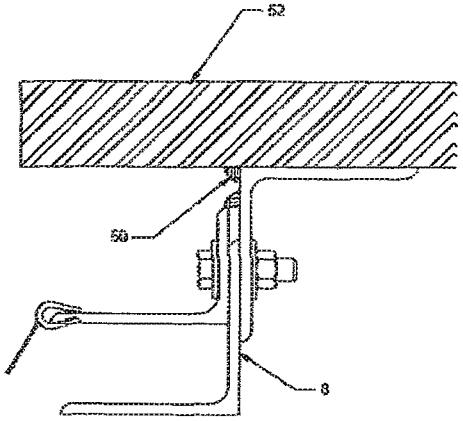
Figure 8G:
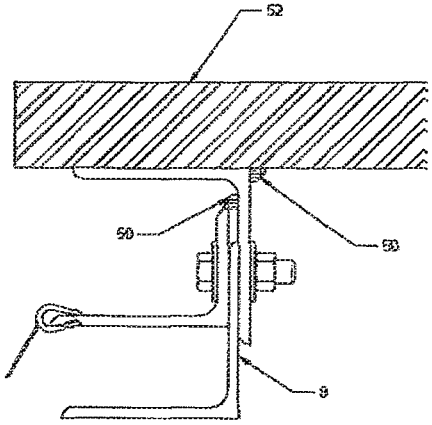
Figure 8H:
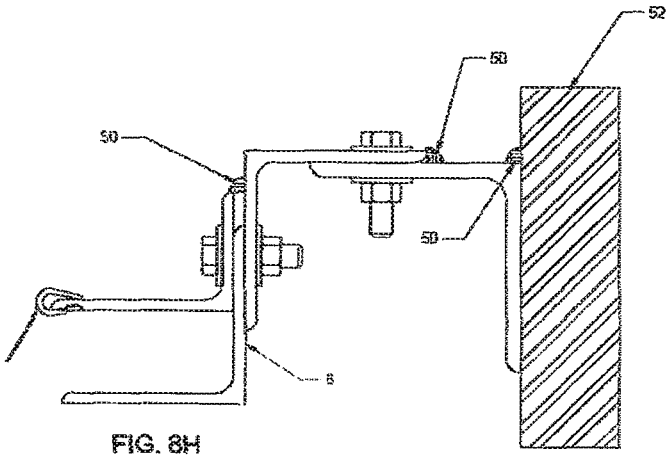

Turning now to FIGS. 4-7, two preferred bracket designs are depicted. FIGS. 4 and 5 depict a Z shaped bracket 28 while FIGS. 6 and 7 depict a L shaped bracket 30 optionally used in combination with mounting angle 32 (FIG. 6) to aid in positioning the brush assembly 18.

In installing the Z shaped bracket 28 field cuts as needed are made to the bracket 28 to produce cutout area 34 to allow for the guide assembly setback and pack-off. With either bracket design, 28, 30 mounting holes 36 are utilized to mount the bracket 28, 30 to the header/lintel 14 with a fastener 40, for example a screw or bolt. Preferably the mounting holes 36 are spaced a maximum of about 24 inches apart. With Z bracket 28 the mounting holes 36 are preferably positioned about equally between the front edge of the header/lintel 14 and the back edge of the bracket 28. With L bracket 30 the mounting holes 36 are preferably positioned about equally between the front and the back edges of the bracket 30. Mounting angle 32 is fixed to L bracket 30 with fastener 44.

The brush assembly 18 is fixed to the bracket 28 or mounting angle 32, for example by inserting brush assembly key 26 into keyway 42. As shown in FIG. 5 there may be more than one keyway 42 to aid in effective brush assembly 18 placement.

The brush assembly 18 is mounted and positioned such that the seal material 20 contacts the closed curtain 6 with the bristles 22, 24 pushed to a predetermined angle, for example about a 55 degree to about a 35 degree angle, preferably about a 45 degree angle. The shorter top set of bristles 24 are faced upward towards the operator counterbalance shaft 10. A sealant 38, for example silicone, may be applied.

In addition to the novel brush configuration, optionally, sealing materials, for example, foam block 46, pressure sensitive seal tape 48, and/or caulking 50 may be placed between the guide assembly 8 and the structure wall 52 to further reduce or prevent air and/or water infiltration as depicted in FIGS. 8*a*-8*h*. The sealing materials also add to the insulation value of the door, thereby achieving a better u-factor than merely adding a higher insulated curtain as is the current practice.

Figure 9:
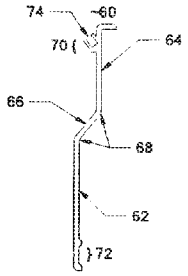
FIG. 9 is a top view of an insulating guide cover.
Figure 10A:
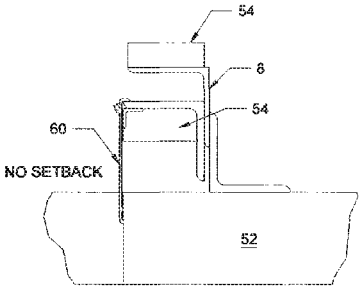
FIGS. 10*a*-10*c* are bottom views of an installed guide seal cover.
Figure 10B:
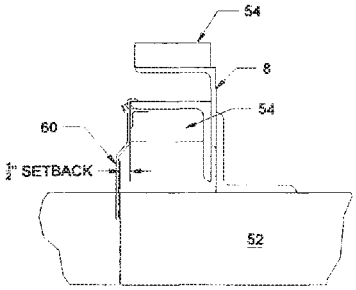
Figure 10C:
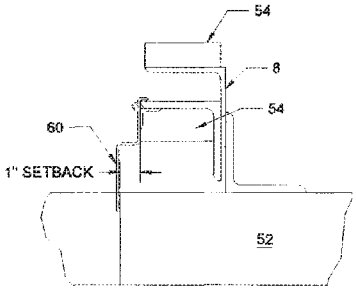

During door installation it is not uncommon that the guide assemblies 8 are set back from the structure opening as depicted in FIGS. 10*a*-10*c*, providing additional avenues for air or water ingress. Turning to FIG. 9, guide cover 60 comprises a first leg 62 and a second leg 64 separated by an inter-hinge area 66 defined by hinges 68 at the inter-hinge area—first leg interface and the inter-hinge area—second leg interface. The second leg 64 comprises a guide assembly engaging geometry 70 and the first leg 62 comprises a structure wall engaging geometry 72. Optional groove 74 receives an optional slide-in weather seal.

Once in place as depicted in FIGS. 10*a*-10*c*, guide cover 60 prevents air or water ingress resulting from the guide assembly setback. Preferably the inter-hinge area 66 is about 1 inch to about 1.75 inches and most preferably about 1⅛ inches in length which allows for effective isolation or sealing of the most common guide assembly setback gaps encountered in the field.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An overhead door comprising:

an operator operatively connected to a counterbalance shaft;

a coiling curtain retained within a first and second curtain retaining guide assembly, windingly and unwindingly attached to the counterbalance shaft; and a lintel seal interface assembly for mounting to a lintel, the interface assembly comprising a brush assembly, the brush assembly comprising a seal material sandwiched between a longer bottom set of bristles and a shorter top set of bristles;

wherein the seal material is a flexible sheet; and wherein the shorter top set of bristles are faced upward towards the counterbalance shaft and the seal material contacts a closed curtain with the bristles pushed to a predetermined angle.

2. The overhead door of claim 1 wherein the shorter top set of bristles are about 1.25 inches to about 0.5 inches shorter than the longer bottom set of bristles.

3. The overhead door of claim 1 wherein the shorter top set of bristles are about 0.75 inches shorter than the longer bottom set of bristles.

4. The overhead door of claim 1 where the predetermined angle is about a 55 degree to about a 35 degree angle.

5. The overhead door of claim 1 wherein the lintel seal interface assembly further comprises a bracket having a first end for mounting to the lintel and a second end attached to the brush assembly.

6. The overhead door of claim 5 wherein the bracket second end comprises a keyway receiving a brush assembly key.

7. The overhead door of claim 5 wherein the bracket is a Z shaped bracket.

8. The overhead door of claim 5 wherein the bracket is an L shaped bracket.

9. The overhead door of claim 1 further comprising a guide cover comprising a first leg and a second leg separated by an inter-hinge area, a first end of the inter-hinge area joined with the first leg at a first hinge, a second end of the inter-hinge area joined with the second leg of a second hinge the second leg engaging the guide assembly and the first leg engaging a structure wall.

10. The overhead door of claim 9 wherein the inter-hinge area is about 1 inch to about 1.75 inches in length.

11. The overhead door of claim 9 wherein the guide cover further comprises a groove for receiving a slide-in seal.

12. The overhead door of claim 1 wherein the shorter top set of bristles are substantially the same length as each other.

13. The overhead door of claim 12 wherein the longer set of bristles are substantially the same length as each other such that a distal end of each bristle in the longer set of bristles terminates at about the same position as a distal end of the flexible sheet when flexible sheet is not contacting a closed curtain.

14. The overhead door of claim 13 wherein the shorter top set of bristles are about 1.25 inches to about 0.5 inches shorter than the longer bottom set of bristles.

15. The overhead door of claim 13 wherein the shorter top set of bristles are about 0.75 inches shorter than the longer bottom set of bristles.

16. A lintel seal interface assembly for mounting to a lintel, the interface assembly comprising a brush assembly, the brush assembly comprising a seal material sandwiched between a longer bottom set of bristles and a shorter top set of bristles; wherein the seal material is a flexible sheet and wherein, when installed, the shorter top set of bristles are faced upward and the seal material is designed for contacting a closed curtain with the bristles pushed to a predetermined angle.

17. The lintel seal interface assembly of claim 16 further comprising a bracket having a first end for mounting to a lintel and a second end attached to the brush assembly, wherein the bracket second end comprises a keyway receiving a brush assembly key.

18. The lintel seal interface assembly of claim 16 wherein the seal material is a flexible sheet and the shorter top set of bristles are about 1.25 inches to about 0.5 inches shorter than the longer bottom set of bristles.

19. An overhead door comprising:

an operator operatively connected to a counterbalance shaft;

a coiling curtain retained within a first and second curtain retaining guide assembly, windingly and unwindingly attached to the counterbalance shaft; and a lintel seal interface assembly for mounting to a lintel, the interface assembly comprising a brush assembly, the brush assembly comprising a seal material sandwiched between a longer bottom set of bristles and a shorter top set of bristles;

wherein the seal material is a flexible sheet; and wherein the shorter top set of bristles are faced upward towards the counterbalance shaft and the seal material contacts a closed curtain;

wherein the shorter top set of bristles are substantially the same length as each other; and wherein the longer set of bristles are substantially the same length as each other such that a distal end of each bristle in the longer set of bristles terminates at about a distal end of the flexible sheet when the flexible sheet is not contacting a closed curtain.

* * * * *